US009259633B2

(12) United States Patent
Meyers

(10) Patent No.: US 9,259,633 B2
(45) Date of Patent: Feb. 16, 2016

(54) ROLLER ASSEMBLY HAVING INTERNAL RESISTANCE COMPONENTS

(75) Inventor: Bradd R. Meyers, Brooklyn Park, MN (US)

(73) Assignee: Kurt Manufacturing Company, Inc., Minneapolis, MN (US)

( * ) Notice: Subject to any disclaimer, the term of this patent is extended or adjusted under 35 U.S.C. 154(b) by 400 days.

(21) Appl. No.: 13/572,160

(22) Filed: Aug. 10, 2012

(65) Prior Publication Data

US 2013/0065734 A1 Mar. 14, 2013

Related U.S. Application Data

(60) Provisional application No. 61/522,496, filed on Aug. 11, 2011.

(51) Int. Cl.

| | |
|---|---|
| ***A63B 69/16*** | (2006.01) |
| ***A63B 21/00*** | (2006.01) |
| ***A63B 21/008*** | (2006.01) |

(52) U.S. Cl.

CPC ..... *A63B 69/16* (2013.01); *A63B 21/0081* (2013.01); *A63B 21/00192* (2013.01); *A63B 2069/163* (2013.01); *A63B 2069/164* (2013.01);

(Continued)

(58) Field of Classification Search

CPC ..... A63B 22/0605; A63B 21/225; A63B 2225/09; A63B 21/0051; A63B 21/005; A63B 21/0081; A63B 21/012; A63B 2071/025; A63B 22/20; A63B 21/00192; A63B 22/0046; A63B 22/06; A63B 69/16; F16D 2121/20; F16D 27/004; F16D 57/002; F16D 2129/065; F16D 2129/08

USPC ..... 482/51, 57–65; 188/161, 163, 158, 164, 188/266, 267, 290

See application file for complete search history.

(56) References Cited

U.S. PATENT DOCUMENTS

| | | | |
|---|---|---|---|
| 2,235,184 | A | 3/1941 | Wettlaufer |
| 3,140,711 | A | 7/1964 | McGathey |

(Continued)

FOREIGN PATENT DOCUMENTS

| | | | |
|---|---|---|---|
| WO | 9813108 | A1 | 4/1998 |
| WO | 9910049 | A1 | 3/1999 |

OTHER PUBLICATIONS http:/en.wikipedia.org/wiki/Bicycle_rollers "Bycycle Rollers", Aug. 1, 2012.

*Primary Examiner* — Loan H Thanh
*Assistant Examiner* — Andrew S Lo
(74) *Attorney, Agent, or Firm* — Steven M. Koehler; Westman, Champlin & Koehler, P.A.

(57) ABSTRACT

The application discloses a roller assembly that utilizes internal resistance components to increase resistance to enhance training intensity. The internal resistance components include a rotatable resistance component or impeller coupled to an outer tubular body of the roller. Embodiments disclosed also include a second resistance component to restrict rotation of the rotatable resistance component increasing the torque required to rotate the outer tubular body. In an illustrative embodiment, the rotatable resistance component forms an impeller which is disposed in a fluid chamber within the tubular body and the second resistance component is disposed in the fluid chamber and maintained in a stationary position to impart resistance to rotation, thus increasing the torque required to rotate the outer tubular body.

18 Claims, 8 Drawing Sheets

(52) U.S. Cl.
CPC ..... *A63B 2069/165* (2013.01); *A63B 2069/167* (2013.01)

(56) References Cited

U.S. PATENT DOCUMENTS

| | | | | | |
|---|---|---|---|---|---|
| 3,961,213 | A | | 6/1976 | Koike et al. | |
| 4,003,375 | A | | 1/1977 | Simjian | |
| 4,580,983 | A | * | 4/1986 | Cassini et al. | 482/61 |
| 4,817,939 | A | * | 4/1989 | Augspurger et al. | 482/61 |
| 4,958,831 | A | | 9/1990 | Kim | |
| 5,248,245 | A | | 9/1993 | Behnke et al. | |
| 5,656,001 | A | * | 8/1997 | Baatz | 482/61 |
| 5,716,331 | A | | 2/1998 | Chang | |
| 5,722,916 | A | | 3/1998 | Goldberg | |
| 5,762,584 | A | | 6/1998 | Daniels | |
| 5,792,030 | A | * | 8/1998 | Sartore | 482/61 |
| 5,916,068 | A | * | 6/1999 | Chisholm et al. | 482/61 |
| 5,944,637 | A | | 8/1999 | Stickler et al. | |
| 6,042,517 | A | * | 3/2000 | Gunther et al. | 482/57 |
| 6,361,477 | B1 | * | 3/2002 | Kolda | 482/61 |
| 6,488,611 | B1 | * | 12/2002 | Ambrosina et al. | 482/63 |
| 6,551,220 | B1 | | 4/2003 | Schroeder | |
| 6,857,992 | B1 | * | 2/2005 | Kolda et al. | 482/61 |
| 6,945,916 | B2 | | 9/2005 | Schroeder | |
| 6,964,633 | B2 | * | 11/2005 | Kolda et al. | 482/63 |
| 7,011,607 | B2 | * | 3/2006 | Kolda et al. | 482/57 |
| 7,585,258 | B2 | * | 9/2009 | Watson et al. | 482/63 |
| 7,766,798 | B2 | | 8/2010 | Hamilton | |
| 2003/0087731 | A1 | * | 5/2003 | Huang | 482/57 |
| 2003/0195089 | A1 | | 10/2003 | Schroeder | |
| 2005/0064999 | A1 | * | 3/2005 | Qiu | 482/57 |
| 2006/0217237 | A1 | | 9/2006 | Rhodes et al. | |
| 2009/0152059 | A1 | * | 6/2009 | Womack et al. | 188/266 |
| 2010/0062909 | A1 | | 3/2010 | Hamilton | |
| 2011/0015046 | A1 | * | 1/2011 | Chen | 482/61 |

* cited by examiner

ROLLER ASSEMBLY HAVING INTERNAL RESISTANCE COMPONENTS

CROSS-REFERENCE TO RELATED APPLICATION

The present application claims the benefit of and priority to U.S. provisional patent application Ser. No. 61/522,496, filed Aug. 11, 2011, the content of which is hereby incorporated by reference in its entirety.

BACKGROUND

Roller assemblies have application for exercise equipment, in particular bicycle trainers or equipment. Bicycle trainers employ one or more rollers which are supported relative to a frame. A user pedals a bicycle to rotate the one or more rollers for exercise and training. One illustrative bicycle trainer employs a series of rollers that are coupled to a frame. The rollers are spaced so that a rider can balance a bicycle upright on the rollers while pedaling. As the rider pedals, the bicycle imparts rotation to the rollers so that the bicycle remains stationary and one or more rollers impart resistance to rotation of the pedals. In another trainer, the bicycle is supported relative to a frame to maintain the bicycle in the upright position. Similarly, the user pedals the bicycle to impart rotation to one or more rollers while the bicycle is fixed to the frame and resistance of the rollers imparts resistance to rotation of the pedals.

SUMMARY

The application discloses a roller assembly that utilizes internal resistance components to increase resistance to enhance training intensity. The internal resistance components include a rotatable resistance component coupled to an outer tubular body of the roller and rotatable with rotation of the tubular body. In illustrated embodiments, a stationary resistance component restricts rotation of the rotatable resistance component increasing torque required to rotate the outer tubular body. In embodiments disclosed, the rotatable resistance component forms an impeller which is disposed in a fluid chamber within the tubular body. In the described embodiments, the stationary resistance component is also disposed in the fluid chamber and maintained in a stationary position to impart resistance to the rotatable resistance component increasing the torque required to rotate the outer tubular body. In one embodiment, the stationary resistance component is retained in a stationary position via a magnetic assembly including one or more magnetic components on the stationary resistance component configured to interact with one or more stationary magnetic components to retain the second resistance component in the stationary position relative to the rotatable resistance component.

DETAILED DESCRIPTION OF ILLUSTRATIVE EMBODIMENTS

Figure 1:
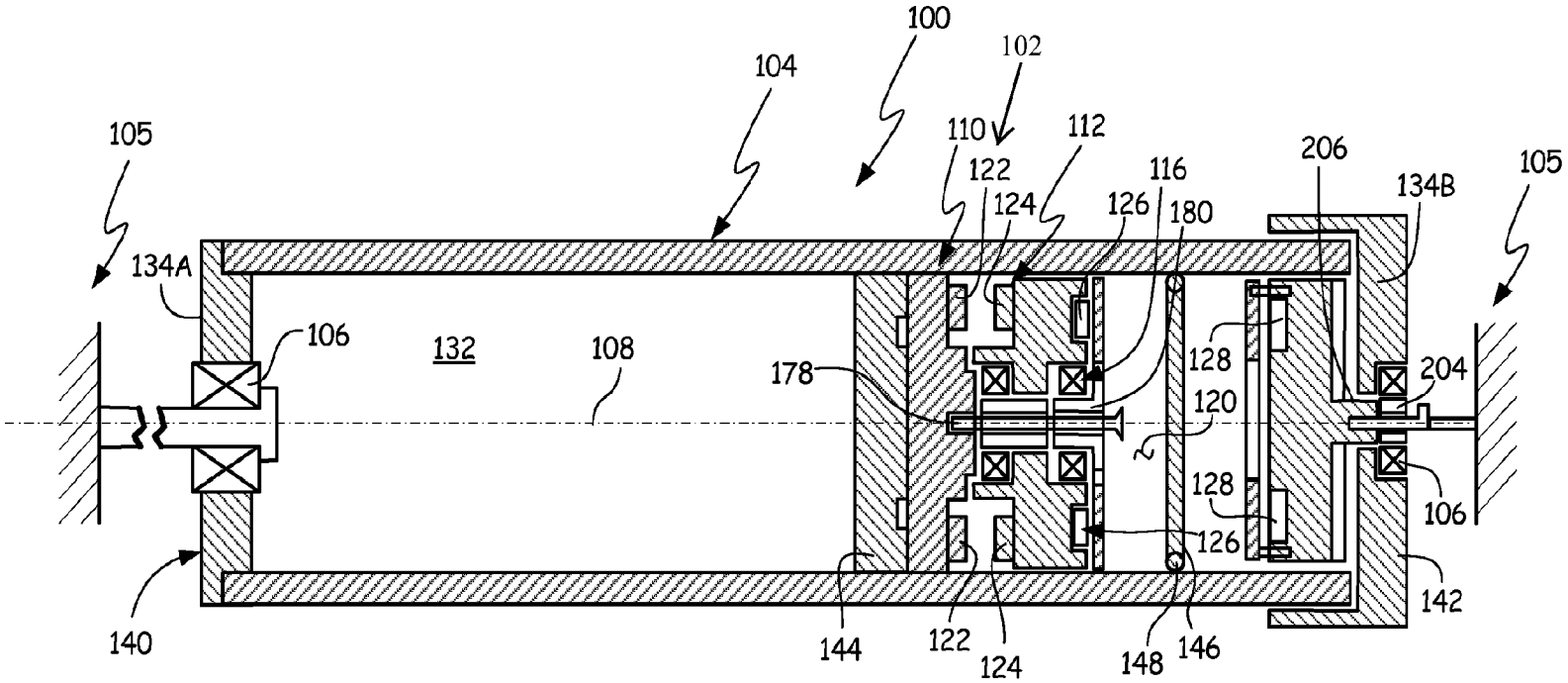
FIG. 1 is a schematic cross sectional view of a roller assembly incorporating an embodiment of a resistance device or assembly described in the application.

FIG. 1 illustrates an embodiment of a roller assembly 100 for an exercise or bicycle training device including resistance components 102. In the illustrated embodiment, the assembly includes a roller 104 rotationally coupled to a stationary frame (illustrated schematically as 105) through bearings 106. During use, an exerciser or user imparts motion to rotate the roller 104 about axis 108. Rotation of the roller 104 about axis 108 is countered by the resistance components 102 to increase required torque to rotate the roller 104.

As shown in FIG. 1, the resistance components 102 include a first resistance component 110 fixed to the roller 104 and a second resistance components 112 coupled to the roller 104 through a bearing assembly 116. The first resistance component 110 forms a rotatable resistance component which rotates about axis 108 via rotation of the roller 104. The second resistance component 112 is held in a stationary position to interact with the first resistance component 110 to impart resistance.

The first and second resistance components 110, 112 are disposed in a fluid chamber 120. The first resistance component includes a plurality of blades 122, which rotate about axis 108 to form an impeller or fluid resistance component. The second resistance component 112 includes a plurality of blades 124 that interact via fluid in the chamber 120 with the plurality of blades 122 on the impeller or first resistance component 110. The second resistance component 112 is held in a stationary position so that the blades 124 restrict fluid flow to impart resistance to rotation of blades 122 and the rotation of the first resistance component 110 (and roller 104).

The second resistance component 112 is held in the stationary position through magnetic components of a magnetic assembly. As described herein, the magnetic assembly includes one or more magnet components 126 on the second or stationary resistance component 112 that interact with one or more magnetic components 128 fixed relative to a stationary portion of frame 105. The interaction of the magnetic components 126, 128 inhibits rotation of the second or stationary resistance component 112 to maintain the second resistance component 112 in the stationary position relative to the first or rotatable resistance component 110. In the schematic illustration of FIG. 1, magnets 126 and 128 are illustrated quite a distance apart but in practice, the magnets 126 and 128 are in close proximity to create a magnetic force that inhibits rotation of the second resistance component 112 to maintain the second or stationary resistance component 112 in the stationary position as described. In an illustrated embodiment, magnets 126 and 128 are approximately 0.110 inches apart.

As shown in FIG. 1, the roller 104 is formed of a tubular body 130 having an inner passage 132 between opposed ends 134A and 134B of the tubular body 130. An end cap 140 closes the passage at end 134A and a threaded cap 142 closes the passage at end 134B. As shown, bearings 106 are supported in end caps 140, 142 to rotationally support the tubular body 130 (or roller 104) relative to the frame 105.

The fluid chamber 120 is formed in the inner passage 132 of the tubular body 130 between partitions 144, 146. An O-ring 148 is used to provide a fluid seal between partition 146 and the tubular body 130. The O-ring 148 seal significantly reduces the possibility of leaks because it rotates with body 130 and thus is stationary with respect to body 130. In illustrated embodiments, the fluid chamber 120 is filled with a fluid such as silicone (e.g., having a viscosity approximately equal to 50 centistrokes). The amount or type of fluid within the chamber can be varied to change the resistance of the assembly. In addition, the number of blades 122, 124 on the first resistance component 110 and the second resistance component 112 can be varied to obtain the desired resistance.

Figure 2:
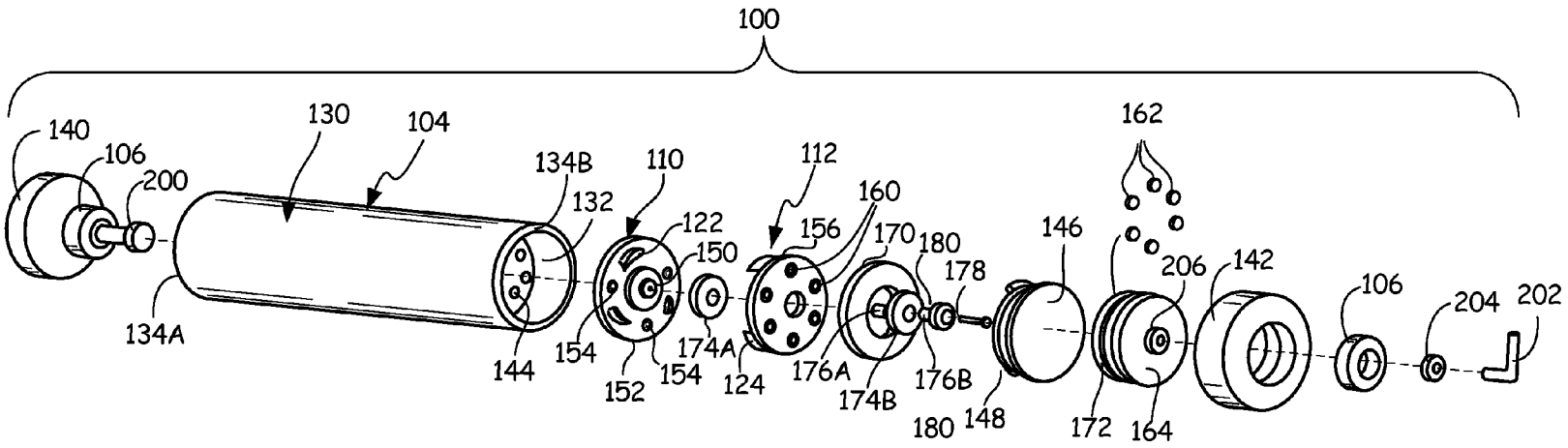
FIG. 2 is an exploded view of the roller assembly of FIG. 1 illustrating components of the resistance device or assembly.

FIG. 2 is an exploded view of the roller assembly 100 where like numbers are used to refer to like parts in FIG. 1. As shown in the exploded view, the first or rotatable resistance component 110 includes curved blades 122 spaced about a central hub 150 of disc 152 to form the impeller. As shown, in FIG. 2, the impeller disc 152 is inserted into passage 132 of the tubular body 130 and connected to partition 144 supported in the tubular body 130. The disc 152 is connected to partition 144 through fasteners (not shown) inserted into openings 154 on the disc 152, although if desired, disc 152 partition 144 and/or body 130 can be integral being formed of a single unitary body. As described, disc 152 rotates with the tubular body 130 to form the impeller of the resistance assembly.

The plurality of blades 124 of the second or stationary resistance component are formed about a central hub of stationary disc 156. Disc 156 is coupled to disc 152 through bearing assembly 116 so that disc 152 (or the impeller) rotates relative to the stationary disc 156. Discs 152, 156 are disposed in chamber 120 such that blades on the rotating impeller interact with the fluid to impart fluid flow, which is resisted by blades 124 on the stationary disc 156.

As previously described, disc 156 is maintained in a stationary position with respect to the rotating impeller or disc 152 through magnetic components 126, 128 of the magnetic assembly. In the illustrated embodiment, blades 124 are formed on a backside of disc 156 facing the impeller and one or more magnetic components 126 of the magnetic assembly are position on the front side of disc 156 to hold the disc 156 in the stationary position.

In the illustrated embodiment, the one or more magnetic components on the front side of disc 156 include a plurality of magnets 160 spaced about a central hub of disc 156. As shown, the plurality of magnets 160 interact with a plurality of magnets 162 spaced about a backside of disc 164 connectable to the frame (not visible in FIG. 2). In the particular embodiment shown, the plurality of magnets 160, 162 include six radially spaced magnets on each disc 156, 164. The magnets 160, 162 are secured to the discs 156, 164 via rings 170, 172 connectable to discs 156, 164.

Although in the illustrated embodiment, the magnetic assembly includes six magnets 160, 162 connected to discs 156, 164, respectively, application is not limited to the specific embodiments or number of magnets shown. For example, any number of magnets can be connected to discs 156, 164 to form the magnetic components of the magnetic assembly. In alternate embodiments, discs 156, 164 are formed of a magnetic material or portions of the discs are magnetic to provide interacting magnetic fields to hold the second resistance component 112 (or disc 156) in the stationary position.

In the embodiment shown in FIG. 2, the bearing assembly 116 rotationally connecting the stationary disc 156 to the impeller disc 152 includes multiple bearings 174A, 174B. The multiple bearings 174A, 174B are connected relative to the hub element 150 of disc 152 and are support about shafts 176A, 176B. As shown, a fastener 178 extends through shafts 176A, 176B and connects to hub 150 to rotationally connect the second resistance component 112 relative to the first resistance component 110. Shaft 176B has a stepped diameter forming an enlarged rim 180. The enlarged rim 180 is sized to abut bearing 174B to retain the second or stationary resistance component 112 rotationally connected to the first resistance component 110.

As previously described, passage 132 is closed by end caps 140, 142. Fastener 200 extends through bearing 106 in end cap 140 to form a stationary or axle portion at which the first end 134A of the roller 104 is coupled to the frame 105. The tubular body 130 is rotationally coupled to the frame or stationary portion through bearing 106 supported in end cap 142 relative to the stationary portion. Fastener 202 extends through an inner ring 204 concentric with bearing 106 in end cap 142. A raised hub element 206 of disc 164 extends into end cap 142. Fastener 202 extends into an opening in the raised hub element 206 of disc 164 to form a stationary or axle portion at end 134B. The roller 104 is connected to the frame 105 at second end 134B through fastener 202 (or stationary portion) and the tubular body 130 is rotationally coupled to the stationary portion through bearing 106 at end 134B.

Figure 3:
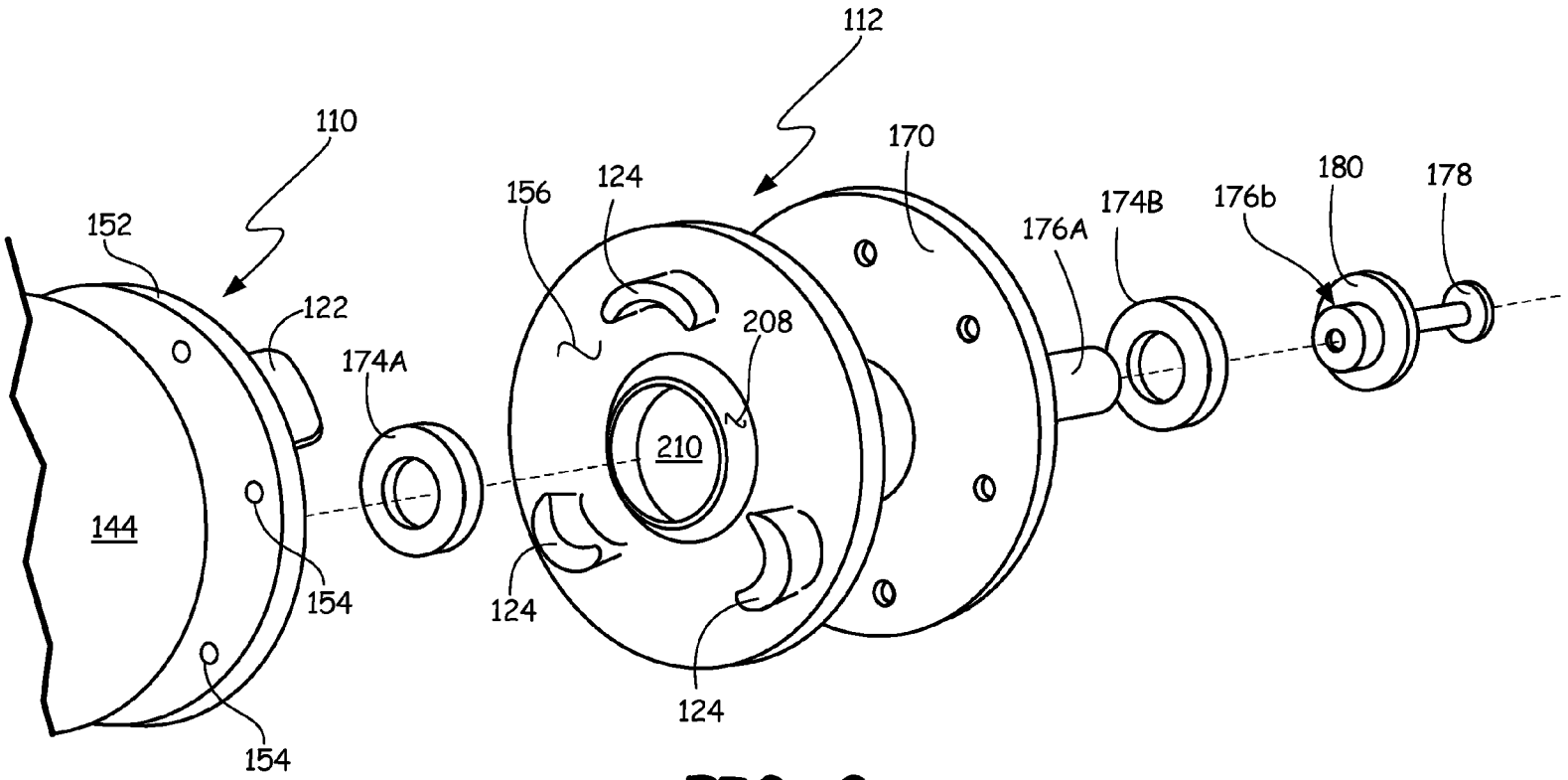
FIG. 3 is a detailed exploded view of first and second resistance components of the resistance device or assembly.
Figure 3A:
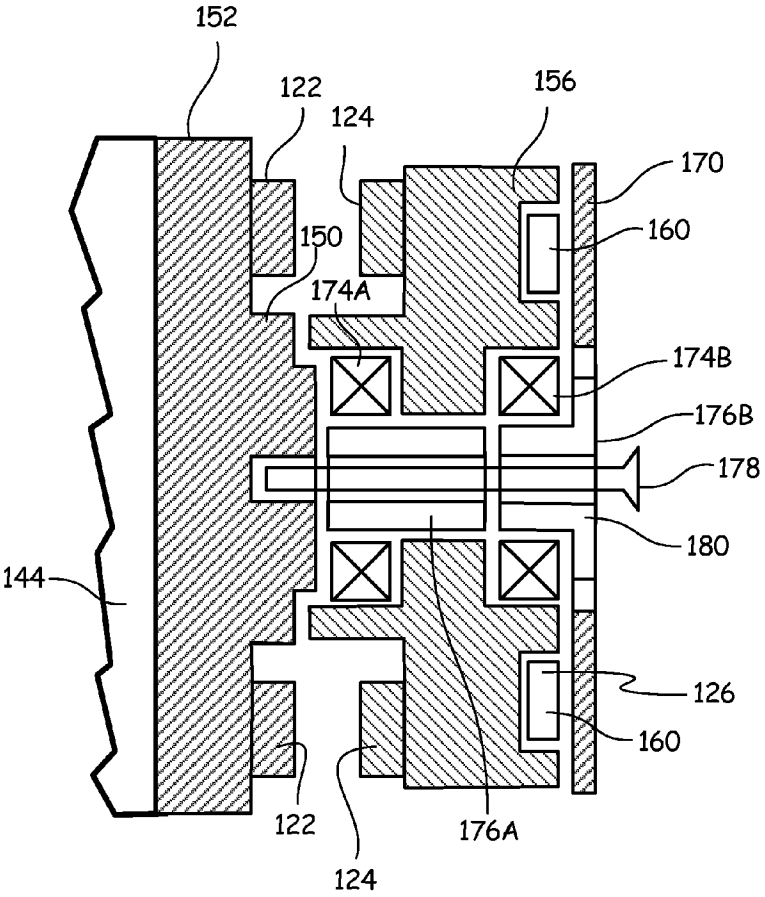
FIG. 3A is a schematic cross-sectional view illustrating assembly of the components shown in FIG. 3.

FIGS. 3 and 3A are enlarged views illustrating parts of the first and second resistance components 110, 112 previously described. As shown, a front side of disc 152 is connected to partition 144 through openings 154. The backside of disc 152 includes the blades 122 and hub 150 (not visible in FIG. 3) to form the impeller or rotatable resistance component 110. Disc 156 includes a central opening 210 sized for insertion of bearings 174A, 174B of bearing assembly 116 rotationally connecting disc 156 relative to disc 152. A front side of disc 156 includes a raised hub 208 extending about the central opening 210. Bearings 174A, 174B are supported in the central opening 210 and raised hub 208 of disc 156. Shafts 176A, 176B extends through central openings of bearings 174A, 174B. Fastener 178 extends through shafts 176A, 176B and inserts into opening on hub 150 (shown in FIG. 3A) to rotationally connect disc 156 relative to disc 152 as described.

Figure 4:
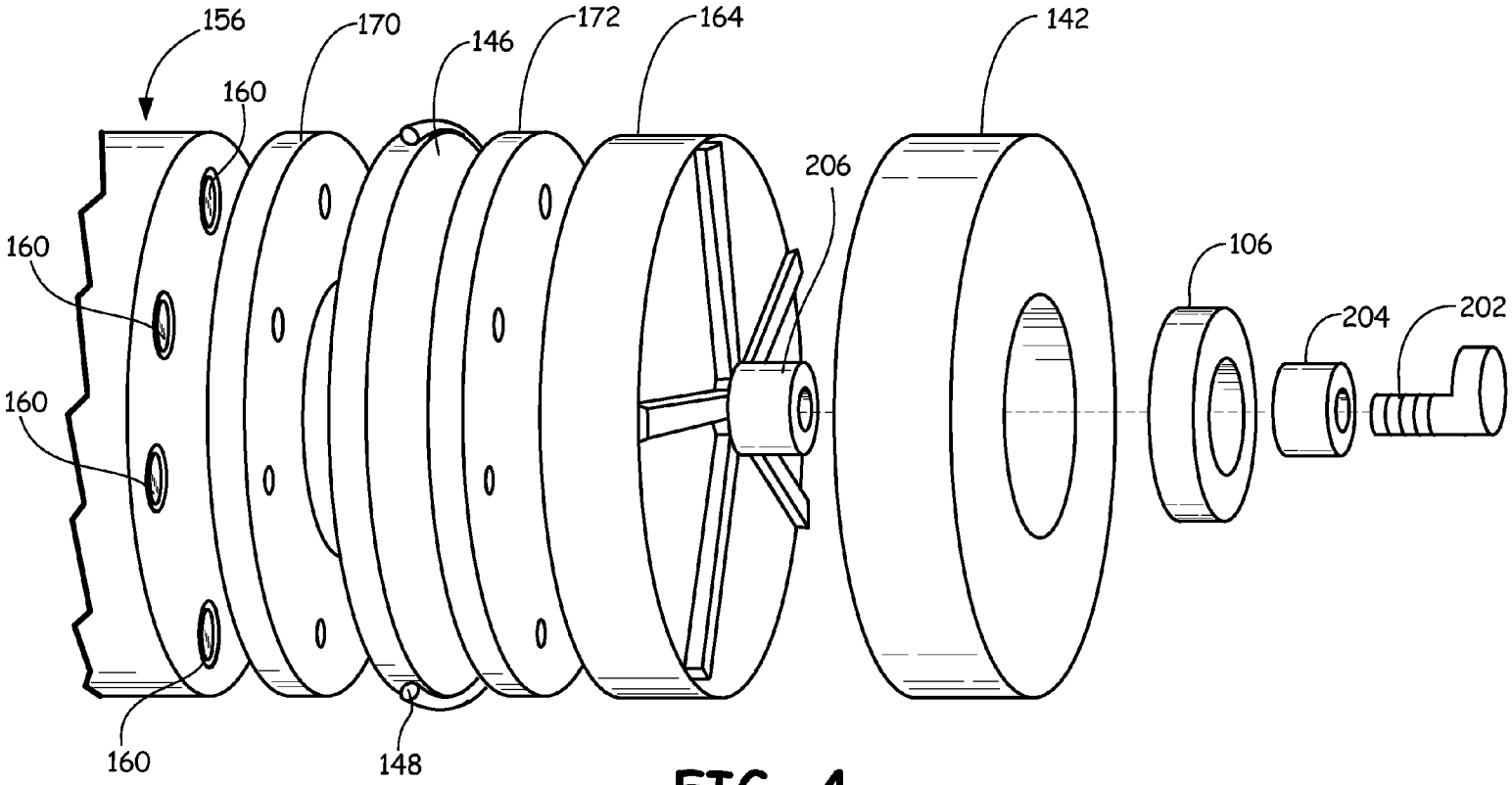
FIG. 4 is a detailed exploded view of magnetic components of a magnetic assembly configured to maintain the second or stationary resistance component in a stationary position.
Figure 4A:
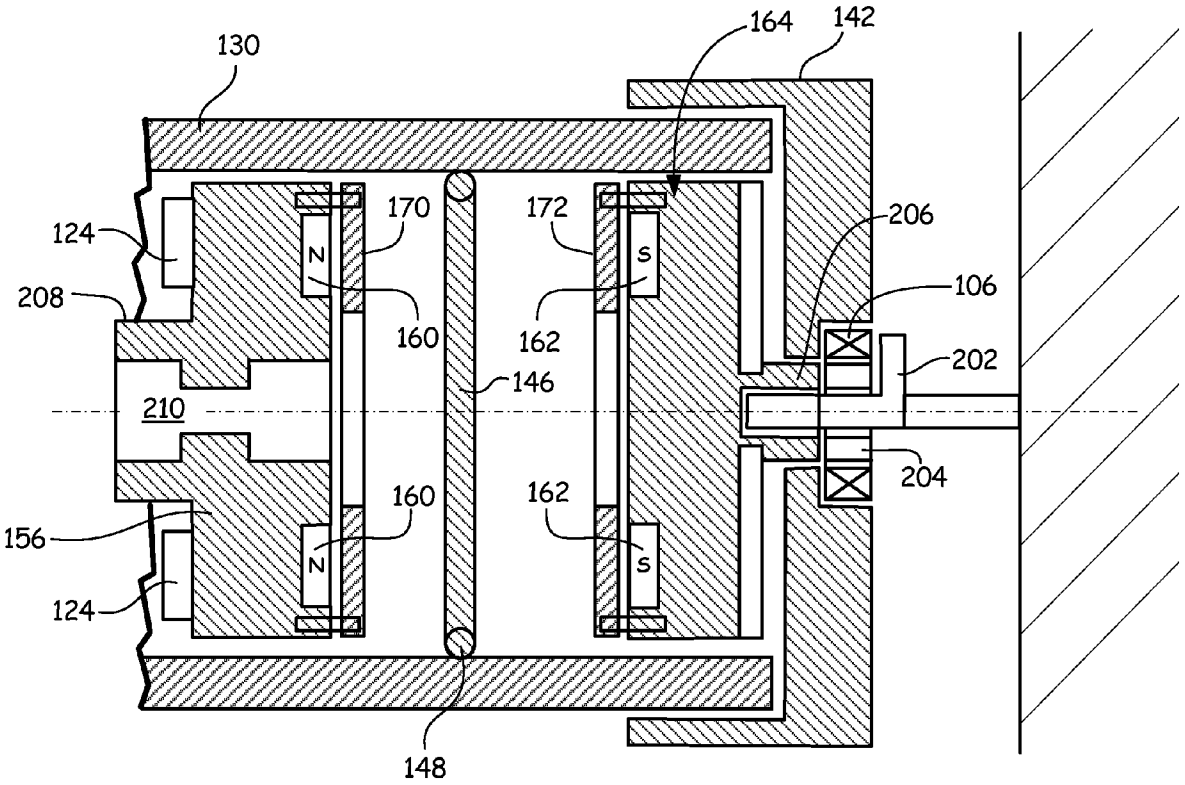
FIG. 4A is a schematic cross-sectional view illustrating assembly of the components shown in FIG. 4.

FIGS. 4 and 4A illustrate magnetic components of the magnetic assembly configured to hold disc 156 in the stationary position. As shown, magnets 160, 162 are assembled in recessions of discs 156, 164 and cover plates 170, 172 are connected to the discs 156, 164 via fasteners to retain the magnets 160, 162 in the recessions. As shown in FIG. 4A, the backside of disc 156 includes magnets 160 having a first polarity and the front side of disc 164 includes magnets 162 having a second opposite polarity so that the magnets 160, 162 create an attraction force to retain disc 156 in a stationary position.

In another embodiment, the magnets spaced around each of the discs 156, 164 can have an alternating polarity where the alternating polarity of magnets 160 of disc 156 align with the magnets 162 on disc 164 to restrict rotation of disc 156. As will be appreciated by those skilled in the art, application is not limited to a particular number or arrangement of magnets to retain the second resistance component 112 in the stationary position, as described.

Illustratively, the magnets can be formed of a high-permeability magnetic material. As used herein "high-permeability magnetic material" shall mean a material used to concentrate magnetic flux from the magnets along a desired path. Commonly, such a material is ferromagnetic, for example, iron or steel, although other materials can also be used. In illustrated embodiments, discs 156, 164 are formed from a non-magnetic material, such as plastic, fiberglass, ceramic, or a paramagnetic material, such as aluminum. An illustrative non-magnetic material includes Garolite™ available from McMaster-Carr of Chicago, Ill. In one embodiment, magnets 160, 162 can be secured to discs 156, 164 by an adhesive such as available from the Loctite Corporation of Rocky Hill, Conn. In other embodiments, the discs 156, 164 are formed of magnetic materials having a desired polarity to provide the magnetic attraction to restrict rotation of the stationary disc 156 as described.

Figure 5:
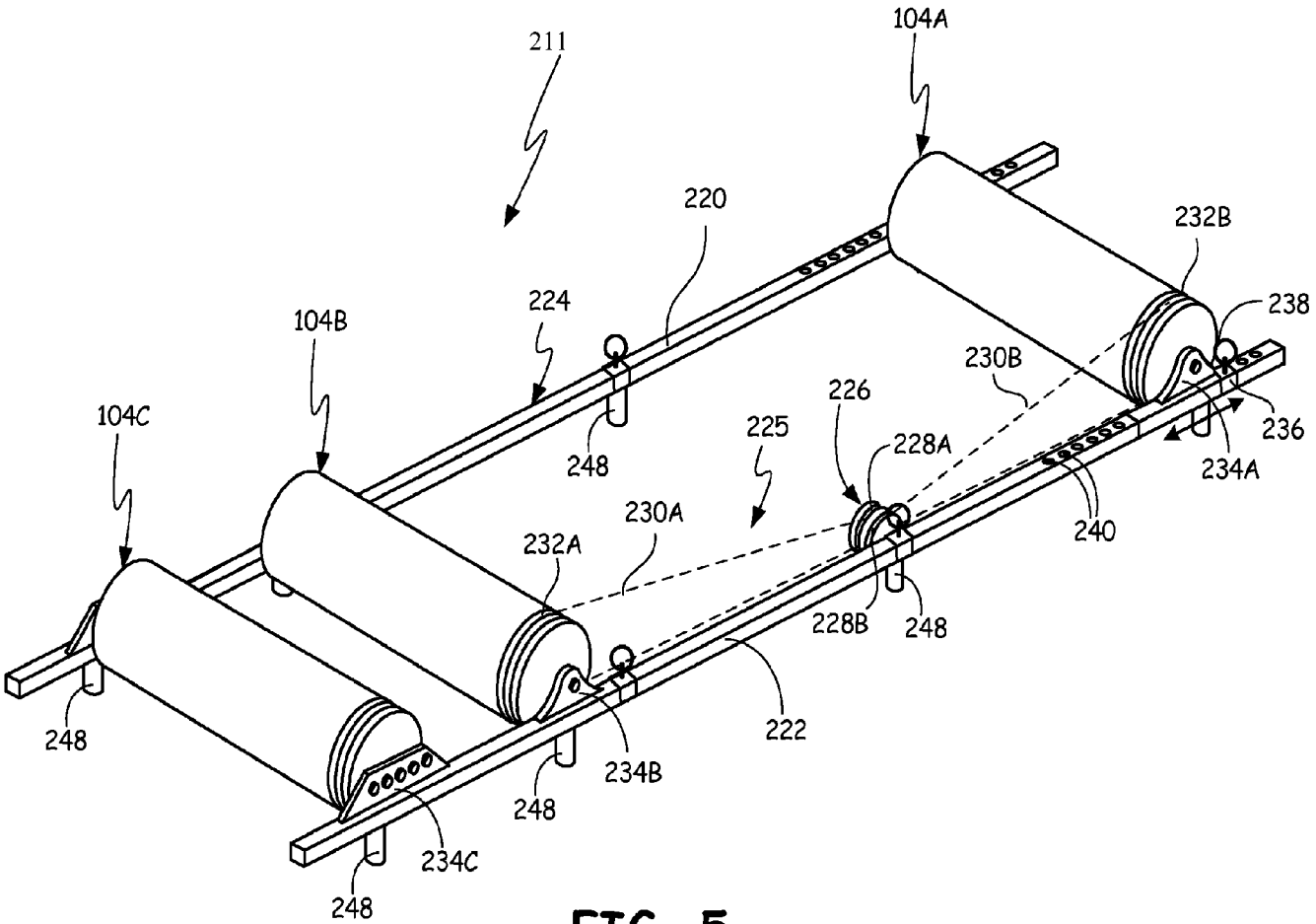
FIG. 5 is a perspective illustration of a training device having a plurality of rollers including resistance components, connected between elongate rails of a support frame to provide resistance for the training device.

FIG. 5 illustrates an embodiment of a training device for use with a bicycle (not shown) incorporating an embodiment of the roller assembly described. As shown, the training device 211 includes a plurality of rollers 104A-104C connected to coextending rails 220, 222 forming supports of a frame 224 of the training device. The rollers 104A-104C are spaced so that roller 104A aligns with a front wheel of the bicycle and rollers 104B and 104C align with a rear wheel of the bicycle. For use, wheels of the bicycle are supported on the rollers 104A-104B so that the bicycle imparts rotation to the rollers 104A-104C. One or more rollers 104A-104C include the resistance components or assembly described to impart resistance.

In the embodiment shown, rotation of the rollers 104A and 104B is interconnected through a pulley assembly 225 to rotationally interconnect the front and rear wheel rollers 104A and 104B. In the embodiment shown, the pulley assembly 225 includes a sheave 226 including grooves 228A-228B. Sheave 226 is rotationally coupled to rail 222 as shown. Rotation of roller 104B imparts rotation to sheave 226 through a continuous loop cable or line 230A (illustrated schematically). A first element of the continuous loop cable 230A is supported in groove 232A extending about an outer circumference of roller 104B and a second element of the cable 230A is supported in groove 228A of sheave 226 to rotationally connect roller 104B to sheave 226. Thus, as described, rotation of roller 104B imparts rotation to sheave 226.

Roller 104A is rotationally coupled to sheave 226 through continuous loop cable 230B. A first element of the continuous loop cable 230B is supported in a groove 232B extending about an outer circumference of roller 104A and a second element of the continuous loop cable 230B is supported in groove 228B of sheave 226. As shown, ends of rollers 104A-C are rotationally connected to rails 220, 222 through brackets 234A-C connected to the rails 220, 222 (only brackets on rail 222 are visible in FIG. 5). The rollers 104A-C are connected to brackets 234A-C through fasteners extending through fastener openings in the brackets 234A-C. As shown, bracket 234C includes a plurality of fastener openings to adjust the spacing of roller 104C relative to roller 104B.

Bracket 234A is connected to a slidable element 236, movable along rails 220, 222 to adjust the position or spacing of roller 104A relative to roller 104B. The position of the slidable element 236 is locked via insertion of pin 238 into slots 240 along rails 220, 222. In the embodiment shown, rails 220, 222 include multiple rail segments, which are slidably interconnected to form the rails 220, 222. The rail segments are locked into position via insertion of pins into one or more slots of the interconnecting rail segments. Selection of multiple slots allows for adjustment of the spacing of rollers 104A-104C to accommodate different bicycle sizes. Feet 248 are connected to the rails 222,244 to support the rollers 104A-104C above the ground for rotation.

Figure 6B:
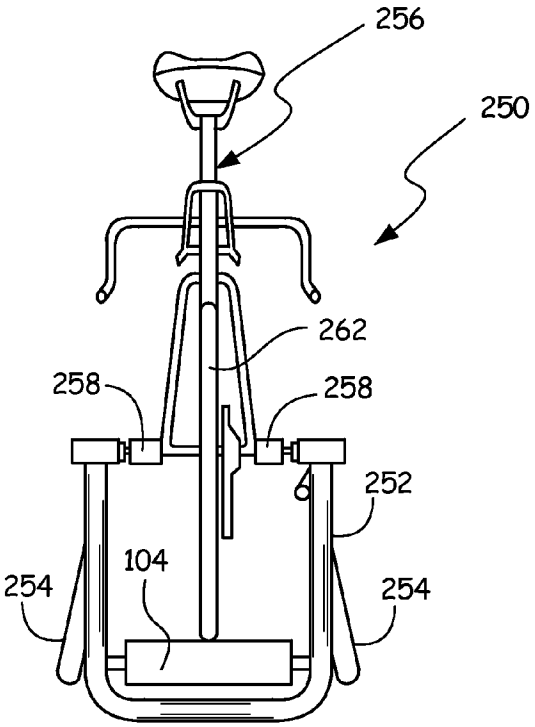
FIGS. 6A-6B illustrate a training device having a roller including resistance components connected to a frame of the trainer to provide resistance.
Figure 6A:
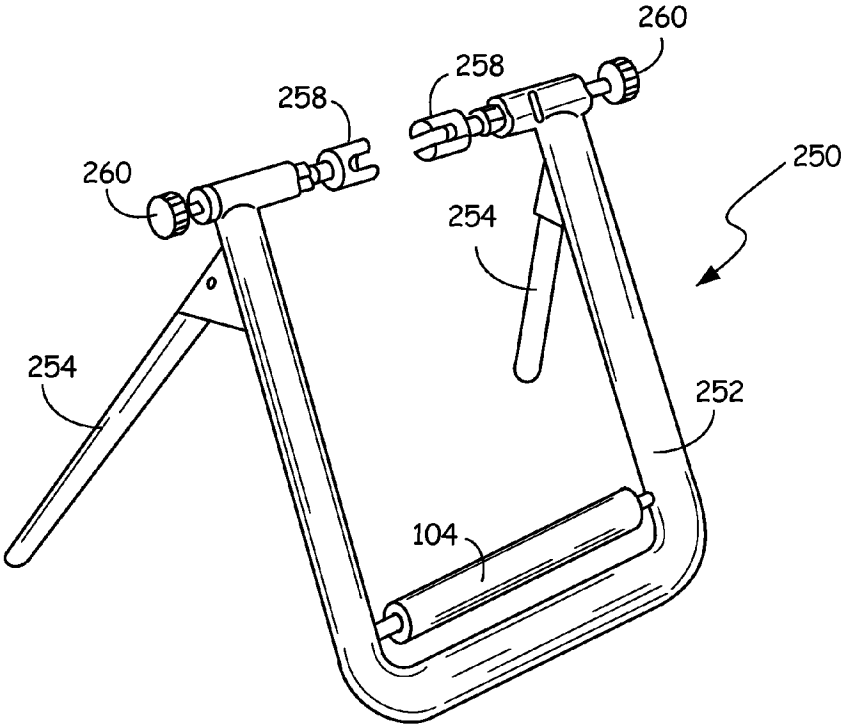

FIGS. 6A-6B illustrate use of the resistance assembly for a bicycle training device 250 having a rear wheel support. As shown, the training device 250 includes a frame 252 and extendable legs 254. Legs 254 are pivotally connected to frame and extend from frame 252 to support a bicycle 256 (shown in FIG. 6B). Clamps 258 or other suitable fasteners, are coupled to frame 252 and are adjusted, for example, via knobs 260 to support a rear wheel 262 of the bicycle 256 as shown in FIG. 6B. As shown, roller 104 is connected to supports 259 of the frame 252. The roller 104 includes a resistance assembly or components to impart resistance to wheels 262 of the bicycle 256 as described in the illustrated embodiments disclosed herein Although the present invention has been described with reference to preferred embodiments, workers skilled in the art will recognize that changes may be made in form and detail without departing from the spirit and scope of the invention.

What is claimed is:

1. An assembly comprising:

a roller having a fluid chamber formed in a tubular body;

a first resistance component coupled to the roller and rotatable relative to a second resistance component, wherein the first and second resistance components are disposed in the fluid chamber; and a magnetic assembly including one or more magnetic components on the second resistance component configured to interact with one or more stationary magnetic components to retain the second resistance component in a stationary position relative to the first resistance component, and wherein the one or more stationary magnetic components are external from the fluid chamber.

2. The assembly of claim 1 wherein the first and second resistance components include a plurality of radially spaced blades disposed in the fluid chamber.

3. The assembly of claim 2 and further comprising:

a frame including a plurality of spaced supports, wherein the roller is rotationally coupled to the plurality of spaced supports, the roller being configured on the frame to support a tire of a bicycle.

4. The assembly of claim 3 and further comprising a second roller and a third roller rotationally coupled to spaced supports on the frame through bearings at opposed ends of the second and third rollers.

5. The assembly of claim 4 wherein one of the second or third rollers is coupled to the first roller through a pulley assembly.

6. The assembly of claim 3 wherein the first and second resistance components include a plurality of radially spaced blades within the fluid chamber.

7. The assembly of claim 6 wherein the fluid chamber is formed between first and second spaced partitions within the tubular body and wherein at least some of the plurality of radially spaced blades are arranged on a disc to form an impeller in the fluid chamber.

8. The assembly of claim 3 each support further includes an end configured to engage the bicycle.

9. The assembly of claim 8 wherein each support further comprises a leg spaced apart from each other and the roller, the frame being configured to hold a rear wheel of the bicycle on the roller.

10. An assembly comprising:

a roller including a tubular body rotationally coupled to a stationary portion through a bearing;

a first resistance component coupled to the roller and rotatable relative to a second resistance component; and a magnetic assembly including one or more magnetic components on the second resistance component configured to interact with one or more stationary magnetic components to retain the second resistance component in a stationary position relative to the first resistance component, and wherein the one or more stationary magnetic components are coupled to the stationary portion of the roller.

11. The assembly of claim 10 wherein a first end of the tubular body is coupled to a first axle portion via a first bearing and a second end of the tubular body is coupled to a second axle portion via a second bearing.

12. An assembly comprising:

a roller having a tubular body rotatable about a stationary axle;

a first resistance component coupled to the roller and rotatable relative to a second resistance component; and a magnetic assembly including one or more magnetic components on the second resistance component configured to interact with one or more stationary magnetic components to retain the second resistance component in a stationary position relative to the first resistance component, and wherein the one or more magnetic components on the second resistance components include a plurality of radially spaced magnets and the one or more stationary magnetic components include one or more radially spaced stationary magnets coupled to the stationary axle of the roller.

13. An assembly comprising:

a roller including a tubular body having a fluid chamber formed within the tubular body between spaced partitions;

a first resistance component coupled to the roller and rotatable relative to a second resistance component; and a magnetic assembly including one or more magnetic components on the second resistance component configured to interact with one or more stationary magnetic components to retain the second resistance component in a stationary position relative to the first resistance component, and wherein the first resistance component is supported relative to a first partition of the spaced partition and comprising a bearing assembly rotationally connecting the second resistance component to the first resistance component.

14. The assembly of claim 13 wherein the first resistance component includes a plurality of blades forming an impeller and the second resistance component is formed of a disc including a plurality of blades on a first side of the disc facing the first resistance component and a plurality of magnets on a second side facing the one or more stationary magnetic components to retain the second resistance component in the stationary position.

15. The assembly of claim 14 wherein the tubular body is rotationally coupled to a stationary axle through a bearing and the one or more stationary magnetic components include a plurality of radially spaced magnets spaced about the stationary axle.

16. An assembly comprising;

a roller having a tubular body rotatably coupled to a stationary portion;

an impeller coupled to the rotating tubular body and disposed within a fluid chamber formed within the tubular body of the roller; and a fluid resistance component disposed in the fluid chamber and configured to resist rotation of the impeller, wherein the fluid resistance component includes a plurality of magnets configured to interface with a plurality of stationary magnets coupled to the stationary portion to restrict rotation of the fluid resistance component within the fluid chamber.

17. The assembly of claim 16 wherein the impeller includes a plurality of radially spaced blades and the fluid resistance component includes a plurality of radially spaced blades to resist rotation of the impeller.

18. The assembly of claim 16 wherein the fluid chamber is formed between spaced partitions within the tubular body and the impeller is connected to a first partition and the fluid resistance component is rotationally coupled to the impeller through a bearing assembly.

* * * * *